United States Patent [19]

Barrington et al.

[11] 4,113,018

[45] Sep. 12, 1978

[54] OIL WELL TESTING SAFETY VALVE

[75] Inventors: Burchus Q. Barrington, Duncan, Okla.; Jim R. Williamson, Carrollton, Tex.

[73] Assignee: Halliburton Company, Duncan, Okla.

[21] Appl. No.: 811,506

[22] Filed: Jun. 30, 1977

[51] Int. Cl.[2] ..... E21B 47/00

[52] U.S. Cl. ..... 166/334; 251/54

[58] Field of Search ..... 166/324, 330, 333, 334, 166/152; 175/318; 251/54

[56] References Cited

U.S. PATENT DOCUMENTS

| | | | |
|---|---|---|---|
| 3,351,133 | 11/1967 | Clark, Jr. et al. | 166/53 |
| 3,354,950 | 11/1967 | Hyde | 166/0.5 |
| 3,435,897 | 4/1969 | Barrington | 251/54 |
| 3,646,995 | 3/1972 | Manes et al. | 166/152 |
| 3,741,305 | 6/1973 | Young et al. | 166/250 |
| 3,814,182 | 6/1974 | Glroux | 175/318 |
| 3,848,669 | 11/1974 | Brown | 166/334 |
| 4,047,564 | 9/1977 | Nix et al. | 166/334 |
| 4,050,512 | 9/1977 | Giebeler | 166/334 |

*Primary Examiner*—James A. Leppink

*Attorney, Agent, or Firm*—Floyd A. Gonzalez; John H. Tregoning

[57] ABSTRACT

A valve for use in conjunction with a testing string in an oil well is disclosed in which the valve is maintained in the open position until the valve is placed in sufficient compression to collapse any slip joint which also appears in the testing string. A pressure piston is present in the valve having one surface exposed to the well annulus and a second surface exposed to a pressure in a flow passage through the testing string. The valve includes a rotatable ball valve and a bypass around the ball for equalizing the pressure above the ball with the pressure below the ball for use in opening the valve from the closed position. A spring means in the valve biases the closed ball toward the open position for opening the ball when a pressure difference across the ball is reduced sufficiently to allow the ball to rotate to the open position.

9 Claims, 8 Drawing Figures

OIL WELL TESTING SAFETY VALVE

BACKGROUND OF THE INVENTION

The present invention relates to valves used in oil wells. More particularly, the invention relates to a safety valve used in connection with a slip joint in a testing string for testing submerged oil well formations.

When testing submerged oil wells from vessels, a slip joint is normally installed above the packers to compensate for wave action. The slip joint is normally placed in the string far enough above an oil well testing packer so that a constant weight of the pipe in the testing string is allowed for expansion of the packer while the slip joint is in motion due to wave action.

The drill pipe above the slip joint is in tension and is normally supported by a hang-off point formed by a built-in upset on the pipe being supported by a corresponding pipe hanger in a subsea test tree normally installed in the ocean floor. After the testing packer is set and the drill string is supported by the hang-off point, it can be seen that if the testing string parts below the hang-off point that the testing string may collapse into the well bore with little or no immediate indication at the surface of the sea on the vessel.

The present invention is a safety valve that is normally placed above the slip joint in that part of the testing string in tension. If the testing string does separate below the hang-off point, the safety valve will close the interior of the testing string after the slip joint is fully collapsed and the safety valve is placed in compression.

A slip joint is disclosed in U.S. Pat. No. 3,646,995 to Manes et al issued Mar. 7, 1972 wherein a stinger is included in the slip joint. At the end of the slip joint is a cap in which the stinger seats when the slip joint is fully collapsed to shut off flow through the apparatus. This slip joint, as illustrated in FIG. 3*a*, does not provide a full opening through the testing apparatus.

Tester valves such as that shown in U.S. Pat. No. 3,435,897 to Barrington issued Apr. 1, 1969 and U.S. Pat. No. 3,814,182 issued to Giroux June 4, 1974 disclose full opening tester valves for placement immediately above a packer wherein a ball valve in the tester valve is rotated to the full opening position when sufficient weight is exerted on the tester valve to operate the mechanism.

A safety valve apparatus disclosed in U.S. Pat. No. 3,351,133 to Clark, Jr. et al issued Nov. 7, 1967 discloses an oil well production safety valve which provides a full opening ball rotatable to the closed position if production pressure is lost and downward weight is thereby directed to the apparatus of the rotatable ball valve.

The present invention includes a ball valve which is held in the normally open position by a spring means. This means biases the valve to the open position to assure that the slip joint normally placed below the safety valve is fully collapsed before the compression placed on either end of the safety valve acts to close the safety valve. Also, a pressure piston is included in the apparatus which, responsive to the pressure differential between the pressure in the well annulus exterior of the tool and the pressure in the center bore of the tool, assists in maintaining the ball in the open position.

The ball opening mechanism includes a bypass means whereby fluid pressure is bypassed around the ball when the ball is being opened from the closed position, to balance the pressure in the bore below the ball with the pressure in the bore above the ball. Also, spring means is provided in the tool to apply an opening force to the rotatable ball such that when a pressure differential across the ball is lowered to the point that the ball may rotate, the ball is quickly rotated to the open position under the influence of the spring means. This spring means prevents an overstress from being applied to the ball rotating pins of the apparatus to prevent these pins from being separated from the ball operating mechanisms of the invention.

Also disclosed is an alternate configuration of the bypass means so that the apparatus of the present invention may be easily converted into a tester valve.

The placement of the invention in a typical testing string and the details of the invention are disclosed in the following drawings:

FIG. 1 showing a schematic view of a typical offshore installation having a testing string disposed in an oil well bore including the invention in the testing string between a slip joint and a subsea test tree;

FIGS. 2*a* -2*b* joined along section lines *a*—*a* through *f*—*f* showing a cross-sectional view of the safety valve.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation flow within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the tubing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

A testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of a testing program, a circulation valve in the test string is opened. Formation fluid in the testing string is circulated out, the packer is released, and the testing string is withdrawn.

Over the years various methods have been developed to open the tester valves located at the formation depth as described. These methods include string rotation, string reciprocation, and annulus pressure changes. One particularly advantageous tester valve is that shown in U.S. Pat. No. 3,856,085 issued Dec. 24, 1974 to Holden et al. This valve operates responsive to pressure changes in the annulus and provides a full opening flow passage through the tester valve apparatus. The annulus pressure operated method of opening and closing the tester valve is particularly advantageous in offshore locations where it is desirable to the maximum extent possible, for safety and environmental protection reasons, to keep the blowout preventers closed during the major portion of the testing procedure.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes a blowout preventer mechanism. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by a hoisting means 11.

A supply conduit 14 is provided which extends from a hydraulic pump 15 on the deck 9 of a floating station 1 and extends to the well head installation 7 at a point below the blowout preventers to allow the pressurizing of the well annulus 16 surrounding the test string 10.

The testing string includes an upper conduit string portion 17 extending from the well site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balance slip joint means 20. Such a slip joint means is disclosed in U.S. Pat. No. 3,354,950 to Hyde issued Nov. 28, 1967.

An intermediate conduit portion 21 is provided for imparting packer setting weight to the packer mechanism 27 at the lower end of the string.

A circulation valve 22 such as that disclosed in U.S. Pat. No. 3,850,250 issued to Holden et al Nov. 26, 1974 may be used near the end of the testing string 10 above the tester valve 25. If it is desired to trap a sample of formation fluid flowing in the testing string 10 at the time tester valve 25 is closed, a combination sample valve and circulation valve may be installed at 22 such as either of those disclosed in Ser. No. 769,123 to Jessup or Ser. No. 769,129 to Barrington, both filed Feb. 16, 1977.

A pressure recording device 26 is located below the tester valve 25. The pressure recording device 26 is preferably one which provides a full opening passageway through the center of the pressure recorder to provide a full opening passageway through the entire length of the formation string.

It may be desirable to add additional formation testing apparatus to the testing string 10. For instance, where it is feared that a testing string 10 may become stuck in the borehole 3, it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run intermediately above the tester valve 25 to provide further data to assist in evaluating the well.

The safety valve 30 of the present invention is added in intermediate conduit portion 19 above the slip joint 20. Such a location is desirable in that the safety valve remains in the full open position until after the slip joint 20 fully collapses. A slip joint closing conduit portion 31 may be located immediately above the slip joint 20 in a position intermediate the safety valve 30 and the slip joint 20 such that the weight of the slip joint closing conduit portion 31 ensures the total collapse of slip joint 20 before the safety valve 30 closes.

Thus, as the testing string 10 is lowered into the borehole the entire string is stretched out in tension. After the packer 27 is set, part of the string will be in tension and part will be in compression. Enough intermediate conduit portion 21 is added to the string between the slip joint 20 and the packer mechanism 27 to ensure that sufficient weight is added to the packer mechanism 27 to tightly engage it with the walls of the casing 4. The slip joint means 20 will allow wave action to be absorbed by the testing string 10 such that the well head closure 13 stays in the same relative position to the work deck 9 during the lowering process until the test tree 18 is landed in the well head installation 7. It can be seen that the intermediate conduit portion 19 between the test tree 18 and the slip joint 20 will remain in tension until slip joint 20 is in the fully collapsed position.

If the testing string 10 should part in the region of the intermediate conduit portion 19, the testing string will fall into the well bore 3. The weight of conduit sections in the intermediate conduit portion 19 will cause slip joint 20 to fully collapse thereby placing safety valve 30 in compression rather than tension. Safety valve 30 is designed to close whenever it is placed in compression as described.

Safety valve 30 may also be used in a land installation in that portion of a testing string which is in tension rather than compression. Such a safety valve will not close unless the testing string breaks, or is otherwise lowered in the well bore, and the safety valve is placed into compression.

DESCRIPTION OF THE PREFERRED EMBODIMENT

Figure 2A:
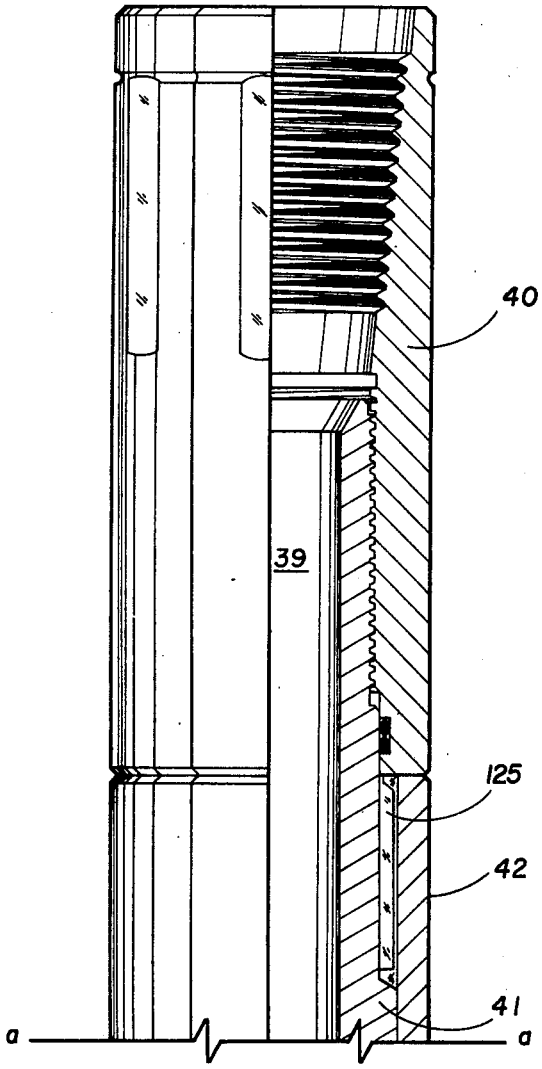
Figure 2B:
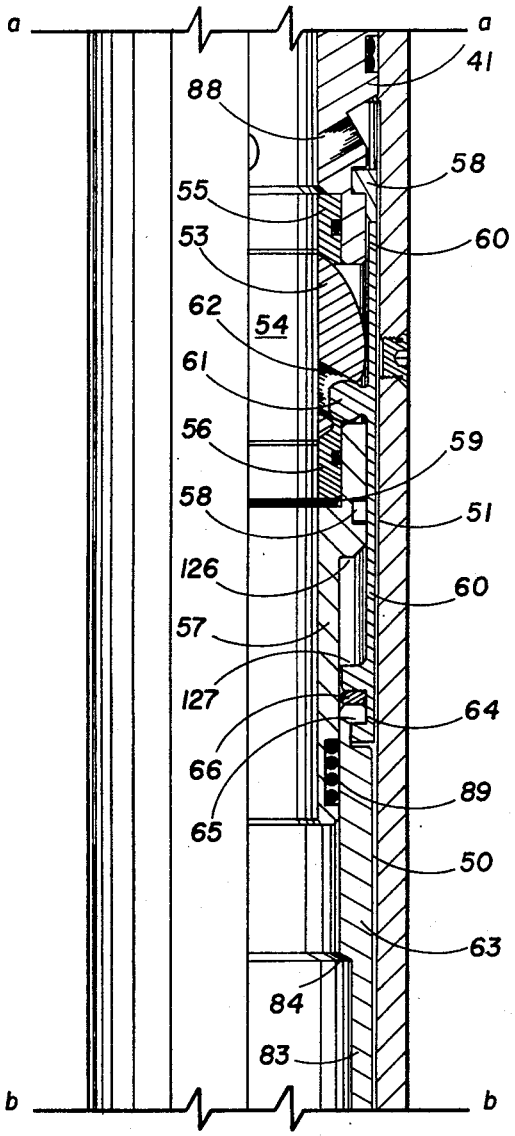

The full opening safety valve for use in oil well testing of the invention is shown in FIGS. 2*a*–2*b*. The apparatus 30 includes a ball valve and bypass section 35, a disconnect section 36, a splined section 37, and a collapsing slip joint section 38.

The apparatus of the invention disclosed includes an open bore 39 which extends through the length of the tool to provide an apparatus with a full opening flow passage therethrough.

The apparatus has an outer housing assembly which includes an upper housing adapter 40 and an upper ball retaining sleeve 41 attached thereto, a valve and bypass housing 42, an intermediate housing 43 having an upper pressure port 44, a spline housing 45 having a lower pressure port 46, and a spline housing end sleeve 47.

Valve and bypass housing 42 includes a larger bypass bore 50, with the upper end of the bypass bore 50 having ball valve chamber 51 and the lower end having an extension spring section chamber 52.

Figure 2C:
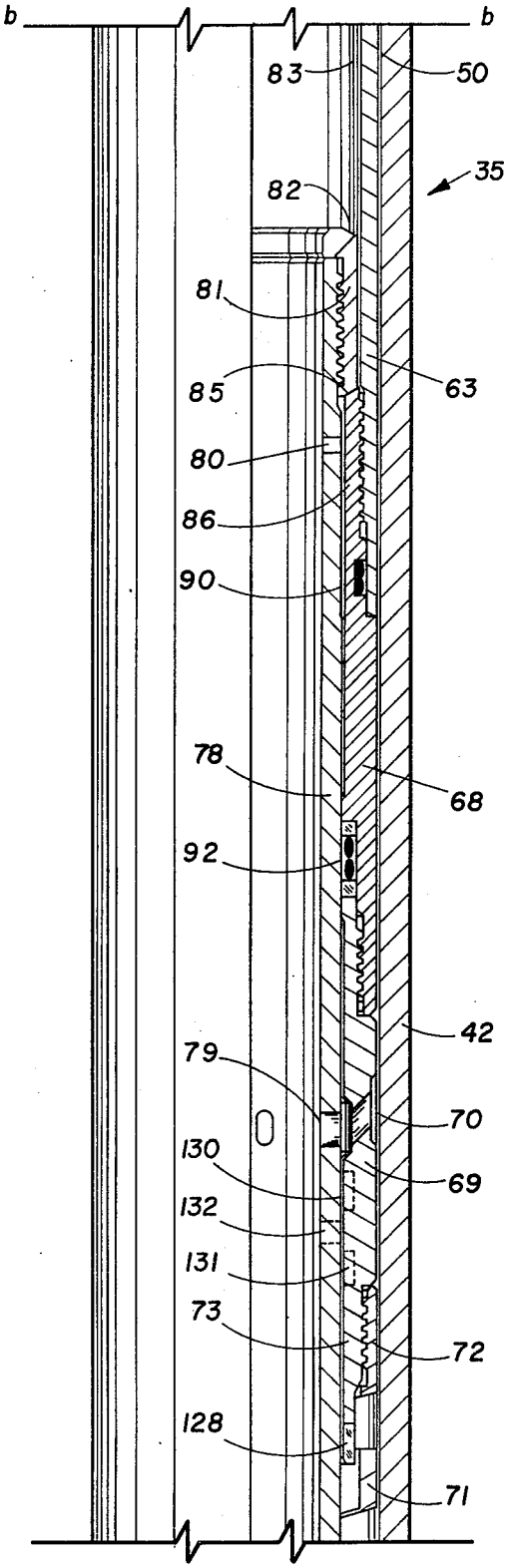
Figure 2D:
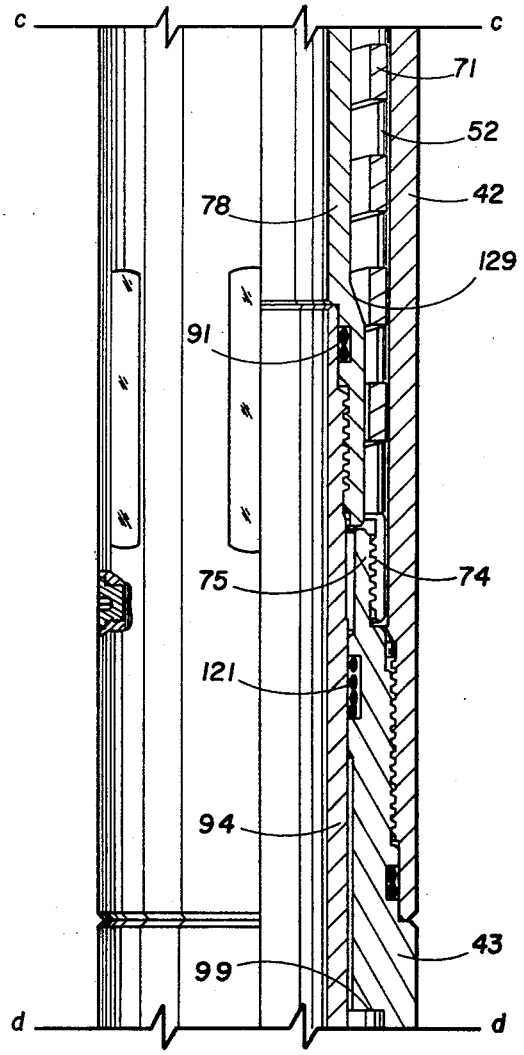
Figure 2E:
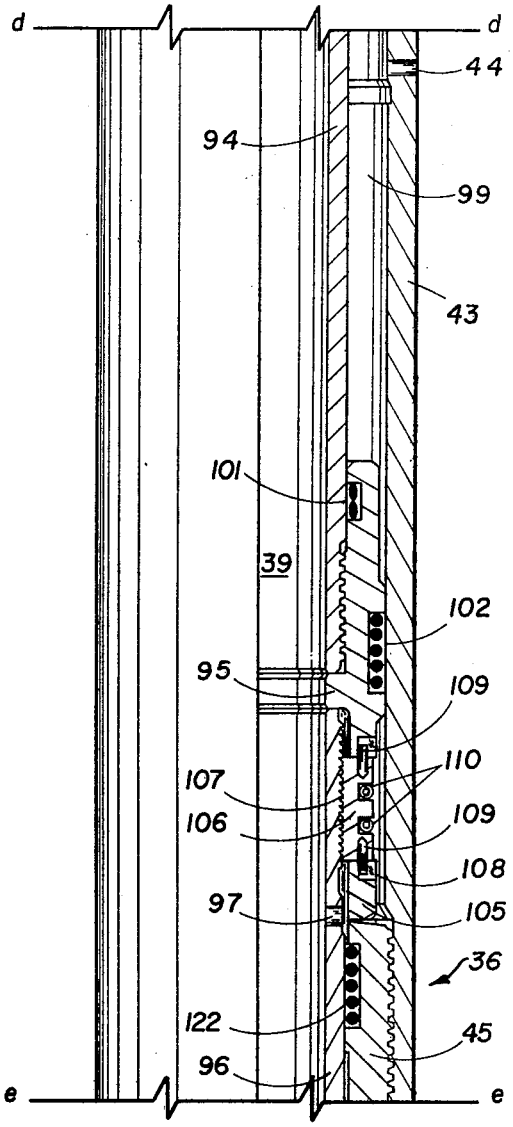
Figure 2F:
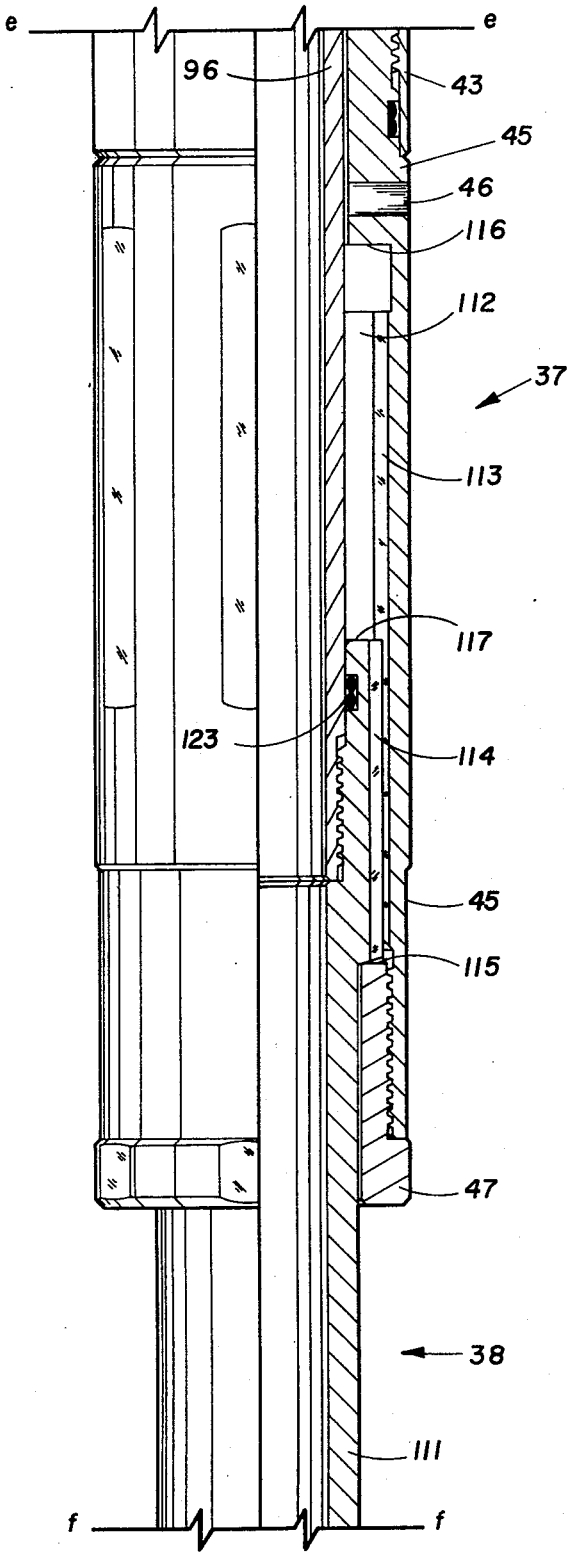
Figure 2G:
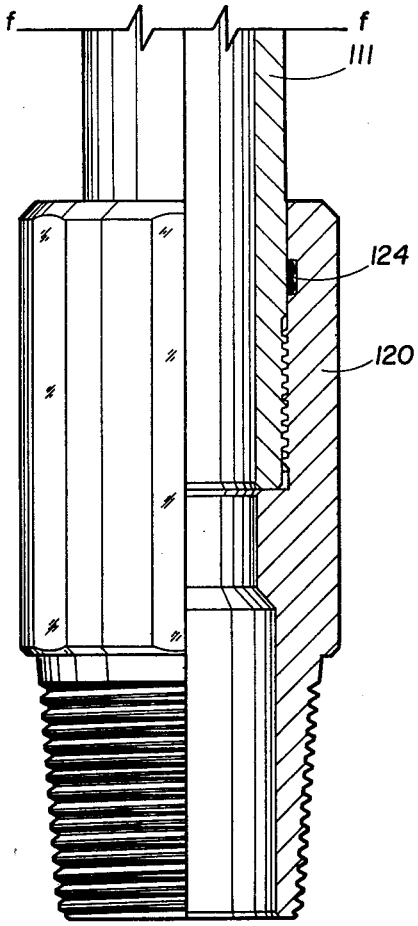

In the disclosure herein FIG. 2*a* is considered the upper end of the apparatus and FIG. 2*g* is considered the lower end of the apparatus. However, it will be understood that the apparatus could be reversed such that FIG. 2*g* would appear at the upper end of the apparatus with FIG. 2*a* being the lower end. This would require some modification of the apparatus but would function the same and be well within the skill of one in the art.

The ball valve mechanism which is located in the ball valve chamber 51 of the enlarged bypass bore 50 includes a ball 53 having a bore 54 through the ball as shown in FIG. 2*b*. The bore 54, when the ball 53 is in the open position, aligns with the bore 39 through the tool to provide a full opening continuous passageway through the apparatus.

Ball 53 is sealed by an upper ball seat 55 and a lower ball seat 56 on either side of the ball 53 as shown in FIG. 2*b*. Ball 53 is held in position by the upper ball retaining sleeve 41 and a lower ball retaining sleeve 57. Sleeves 41 and 57 are held in place by C-clamps 58 which extend from above the ball to below the ball in appropriate slots provided in the sleeves 41 and 57. There are a pair of C-clamps 58 which are placed intermediate of pin arms 60 which are in the bypass bore 50 and which slide past the C-clamps 58 to operate the ball 53. This arrangement is known in the art and is shown and discussed in other U.S. Patents for instance, U.S. Pat. No. 3,814,182 issued to Giroux June 4, 1974.

Belleville type springs 59 urge seats 55 and 56 into contact with ball 53 to form fluid tight seals.

Pin arms 60 include ball operating pins 61 which extend into holes 62 provided in the ball 53. These pins 61 and the pin arms 60 are designed such that as pin arms 60 move upwardly in the ball valve chamber 51 that the ball 53 will be rotated to the closed position. Whereupon, bore 54 through the ball 53 will be at right angle to the bore 39 through the apparatus and be sealed by seats 55 and 56 to prevent fluid communication past the ball.

Pin arms 60 are connected to an operating mandrel 63 by the lower end 64 of each pin arm 60. As can be seen in FIG. 2*b*, lower end 64 has a C-shaped cross-section. The upper end 65 of operating mandrel 63 has a groove arranged to be intermediate the C-shaped cross-section end 64 for pushing and pulling pin arms 60 as operating mandrel 63 moves upwardly and downwardly. An appropriate cushion means 66 is placed between ends 64 and 65.

The lower end of operating mandrel 63 is threadably connected to an intermediate bypass mandrel 68. The lower end of intermediate bypass mandrel 68 is in turn threadably connected to a lower bypass mandrel 69. Lower bypass mandrel 69 includes bypass port 70 for allowing fluid communication into enlarged bypass bore 50.

An extension spring 71 appears in spring chamber 52. This extension spring 71 has a threaded upper end 72 which is threadably connected with the threaded lower end 73 of lower bypass mandrel 69. A lower threaded extension 73 of extension spring 71 is connected to a threaded extension 75 of the upper end of housing section 43. Thus, as pin arms 60 move upwardly in relation to the housing assembly to rotate the ball 53 to the closed position, it can be seen that the extension spring 71 will be stretched or extended since its upper end 72 is connected to the interconnected mandrels 63, 68 and 69, and its lower end 74 is attached to the outer housing section 43.

The apparatus includes an internal sliding mandrel assembly which moves upwardly in relationship to the outer housing assembly as collapsing slip joint section 38 collapses to allow the outer housing mandrel assembly to move downwardly.

The internal sliding mandrel assembly includes an upper sliding mandrel 78 as shown in FIGS. 2*c* and 2*d*. The upper sliding mandrel 78 includes bypass port 79 which, when the bypass is in the open condition, communicates to allow fluid from the interior bore 39 of the apparatus through port 79 and port 70 to the bypass bore 50. Upper sliding mandrel assembly 78 also includes a pressure port 80 as shown in FIG. 2*c*.

An upper push-pull sleeve 81 is attached to the upper end of sliding mandrel 78 which includes an upward facing surface 82. Push-pull sleeve 81 slidably moves upwardly and downwardly in an enlarged bore area 83 provided in operating mandrel 63.

At the upper end of enlarged bore area 83 is a downwardly directed face 84. This downwardly directed face 84 limits the travel of sleeve 81 and the attached upper sliding mandrel 78. When upwardly directed face 82 and downwardly directed face 84 come in contact with one another as the sliding mandrel assembly is moving upwardly, face 82 pushes face 84 upwardly and causes operating mandrel 63 to also move upwardly.

The cooperating faces of sleeve 81 and extension 86 of the intermediate bypass mandrel 68 is provided in area 85 to allow the interior sliding mandrel assembly to pull operating arm 63 in the downward position after push-pull sleeve 81 has moved the lower limit of the enlarged bore area 83.

A bypass port 88 is provided through the upper ball retaining sleeve 41 to allow bypass communication of fluids from the inner bore 39 to the enlarged bypass bore 50. It can thus be seen that when ball 53 is in the closed position and bypass ports 79 and 70 communicate with one another allowing the bypass bore to be open, that fluid communication may flow around the ball through the bypass port 88 into ball valve chamber 51 of bypass bore 50 to the communicating bypass ports 70 and 79 and then back into the interior bore of the apparatus 39.

Seals 89, 90 and 91 are provided to seal the interior bore 39 of the apparatus from the bypass bore 50. Bypass seals 92 are provided to open and close the apparatus bypass as port 79 in upper sliding mandrel 78 moves past the bypass seals 92.

The internal sliding mandrel assembly also includes an intermediate sliding mandrel 94 shown in FIG. 2*e*. This intermediate sliding mandrel 94 is threadably connected at its upper end to upper sliding mandrel 78 and threadably connected at its lower end to a pressure piston 95. Below pressure piston 95 is a locking mandrel 96 designed to be latched into the piston 95 so that the tool may be easily disassembled for transportation. A pressure port 97 also is located in locking mandrel 96 as shown in FIG. 2*e*.

A piston chamber 99 is provided by an enlarged bore in housing section 43. This piston chamber 99 is designed for pressure piston 95 to move upwardly and downwardly as the inner sliding mandrel assembly moves in relationship to the outer housing assembly as the outer housing assembly moves downwardly under the weight of a drill string. Seals 101 seal the interior bore 39 from the annulus pressure which appears in chamber 99 and is admitted by port 44 through housing section 43. Seals 102 are provided in pressure piston 95 to seal the annulus pressure which appears in the upper portion of chamber 99 from the interior bore pressure which appears in the lower portion of chamber 99. The interior bore pressure is transmitted to the lower portion of chamber 99 by the port 97.

The disconnect section 36 includes an extension 105 of the pressure piston 95. Extension 105 includes a plurality of latch blocks, one of which is shown as latch block 106. Latch block 106 also has helical cooperating teeth 107. The teeth cooperate with corresponding teeth which appear in the latching mandrel 96. The front of these teeth are slanted and the teeth have straight backs so that the mandrel may be advanced in the upward direction with the slanted teeth pushing the latch block radially outwardly. The latch mandrel 96 may not be pulled from the latch block because of the straight backs of the teeth shown at 107. These cooperating teeth also have a helical design such that the locking mandrel 96 may be screwed into the latch blocks 106. Likewise, the latch mandrel may be unscrewed in the reverse direction to remove the latch mandrel 96 from engagement with the latch blocks 106.

The latch blocks are located in a window 108 in extension 105. Pins 109 are pinned into the latch blocks and rest in extensions in the window 108 to prevent the latch blocks from falling through the window 108. Coil springs 110 completely encircle the latch blocks 106 and extension 105 to urge the latch blocks 106 radially inwardly.

The splined section 37 includes an inner sliding spline mandrel 111 which is threadably connected to the lower end of locking mandrel 96 as shown in FIG. 2*f*. The splines 114 of spline mandrel 111 ride in a spline chamber 112 which is located in the splined housing 45. Splines 113 on the splined housing 45 cooperate with the splines 114 on the mandrel 111 to transmit rotation through the splines and thus through the apparatus from the testing string portion above the apparatus to the testing string portion below the apparatus.

Spline chamber 112 has a lower limitation shown in the area of 115 wherein a downwardly directed face of the splines 114 are stopped by an upwardly directed face of the end sleeve 47 which is threadably attached to the lower end of spline section housing 45 as shown in FIG. 2*f*. This lower limit stops the telescopic extension of the inner sliding mandrel assembly out of the housing assembly.

An upper limit of the sliding spline mandrel 111 in the spline chamber 112 is formed by a downwardly directed face 116 of the spline section housing 45 and an upwardly directed face 117 of the sliding spline mandrel 111. This upper limit stops the telescopic contraction of the apparatus as the inner sliding mandrel assembly moves upwardly into the outer housing assembly as the slip joint section 38 collapses.

The slip joint section 38 is made up of the lower portion of the spline mandrel 111 which moves into and out of the end sleeve 47 of the outer housing assembly. A lower adapter 120 is threadably attached to the spline mandrel 111 and is threaded for attaching the apparatus into the testing string below the apparatus.

Seals 121, 122, 123 and 124 are provided to seal the inner bore 39 from the exterior pressure which exists in the annulus of the oil well. Cooperating splines 125 are provided between the upper adapter extension 41 and the ball valve and bypass housing section 42 to assist in the assembly of the apparatus and to transmit rotary action in the testing string above the apparatus to the testing string below the apparatus. The inner sliding mandrel assembly is assembled and the ball valve actuating mechanism, including the ball valve operating mandrels and the extension spring, are assembled and then the ball valve and bypass housing section 42 is lowered over these assemblies and threadably attached into the intermediate housing 43. It can thus be seen that C-clamps 58 are free to rotate in the respective grooves of the upper ball retaining sleeve 41 and the lower ball retaining sleeve 57. Also the pin arms 60 are free to rotate in their respective inner connecting grooves in operating mandrel 63. When the threaded connection between the ball valve and bypass housing 42 is completely threaded into the threaded connection with intermediate housing 43 the upper adapter 40 may be screwed onto the threaded connection with the upper ball retaining sleeve 41.

To operate the apparatus 30 of the invention it is necessary to put the apparatus into compression such as when the testing string above the apparatus separates or by lowering the testing string from the surface to rest on the packer mechanism 27. After the slip joint assembly 20 has fully collapsed, the weight of the testing string above the assembly and the weight of the apparatus itself causes the outer housing assembly to move downwardly collapsing slip joint section 39 and advancing the splines 114 of the spline mandrel 111 upwardly in relation to the outer housing assembly in spline mandrel 112. The inner mandrel assembly is moved upwardly while the restraining force of extension spring 71 holds the bypass mechanism approximately in the position shown in FIG. 2*a*—2*g*. When bypass port 79 passes seals 92 in the upwardly direction the bypass bore 50 is isolated from the pressure in the interior bore 39. Faces 82 and 84 are joined together such that the upper sliding mandrel 78 may push the operating arm 63 of the ball valve operating mechanism. As the outer housing mandrel continues to move downwardly, the inner sliding mandrel assembly pushes upwardly on the operating arm 63 which in turn rotates the ball 53 to the closed position by the actions of the pin 61 in pin arm 60. When downwardly directed face 126 of the lower inner sleeve meets the upwardly directed face 127 of the pin arm 60, the ball is in the fully closed position. The spline chamber 112 is also designed to be fully collapsed when the ball is in the fully closed position such that downwardly directed face 116 and upwardly directed face 117 are resting on each other in the fully closed position and transmitting the weight of the testing string above the apparatus to the testing string below the apparatus.

The lower extension of the lower bypass mandrel 73 is slotted to form flexible fingers 128 such that when the slanted face 129 of the upper sliding mandrel 78 reaches these fingers the fingers may be urged outwardly allowing the ball 53 to be rotated to the fully closed position. These fingers 128 and sliding surface 129 are included to allow for tolerance differences which may cause the inner sliding mandrel assembly to move further into the outer housing assembly in one tool as opposed to another tool.

When it is desired to open the safety valve of the present invention, the drill string 10 is picked up from the surface such that the apparatus 30 is placed in tension. The inner sliding mandrel assembly thus moves down with respect to the outer housing assembly after the outer housing assembly moves upwardly with the testing string 10. It can thus be seen that this movement will move upper sliding mandrel 78 toward the open position until passages 79 and 70 communicate to open the bypass.

The higher formation pressure in the inner bore 39 of the assembly tends to hold the ball 83 in the closed position. The increased friction between the ball 83 and the upper seat 58 is such that if, in some cases, the ball were attempted to be opened that the pins 61 could be pulled from the pin arms 60. This resistance is sufficient to hold the ball closed and to keep the extension spring 71 extended.

With the bypass assembly open, the higher pressure in the bore 39 below the closed ball 53 bleeds off through communicating ports 79 and 70 into bypass bore 50 and above the ball through port 89 and the pressure differential is reduced. When the pressure differential is reduced sufficiently to allow the ball 53 to rotate to the open position, the extension spring 71 will provide the force necessary to rapidly rotate the ball 53 to the open position by the actions of pins 61 in hole 62.

It is preferred that extension spring 71 is preloaded to urge the apparatus 30 toward the opened position. This occurs since extension spring 71 pulls directly through mandrels 63, 68 and 69 to the lower ends of the pin arms 60 to rotate the ball 53 to the open position. It may also be seen that sufficient weight must be acted on the outer housing assembly to extend the spring 71 to rotate the ball 53 to the closed position.

With the apparatus 30 in the well bore 3, the pressure in the well annulus 16 will normally be higher than the pressure in the inner bore 39. The higher annulus pressure acting on the top of pressure piston 95 through port 44, and the lower bore pressure acting on the lower side of pressure piston 95 through port 97 will result in a downward force acting on the inner sliding mandrel assembly tending to hold the slip joint section 38 in the expanded condition shown in FIGS. *2f* and *2g*. This force tends to offset the closing force of the annulus pressure acting on the bottom of the string 10 as, for instance, on a closed valve in tester valve 25 as the string is lowered into the well bore. This downward directed force will also tend to extend the tool slip joint section 38.

After the slip joint means 20 in the testing string is collapsed, for instance due to conduit 19 parting, the inner sliding mandrel assembly will be supported by the lower portion of the testing string 10 through the collapsed slip joint means 20, thus allowing relative movement between the outer housing assembly and the inner sliding mandrel assembly to close the rotatable ball 53.

Chamber 99 may also be extended, and a spring may be placed therein to oppose the collapsing movement between the outer housing assembly and the inner sliding mandrel assembly between the top of chamber 99 and pressure piston 95. This spring will thus oppose the collapsing of slip joint means 38 until after the slip joint apparatus 20 has fully collapsed.

It can also be seen that with a few revisions the apparatus of the present invention may be converted into a tester valve which operates by the upwardly and downwardly manipulation of the testing string 10. In this case such a tester valve may be used in lieu of the tester valve 25 shown in FIG. 1 to be operated by raising and lowering the testing string.

To convert the apparatus of the present invention to a tester valve described, the chamber 99 would be lengthened and redesigned to include a hydraulic metering system to control the relative sliding movement of piston 95 between the outer housing section 43 and the inner sliding mandrel assembly. Also to make the apparatus of the present invention into a tester valve, the bypass port 79 would be moved downwardly to the position shown by reference number 132 in upper sliding mandrel 78. Sealing means would be provided in the bypass mandrel 69 at the positions shown by reference numerals 130 and 131. The ball would also be rotated to be in the closed position when the apparatus is in its normally extended configuration.

Figure 1:
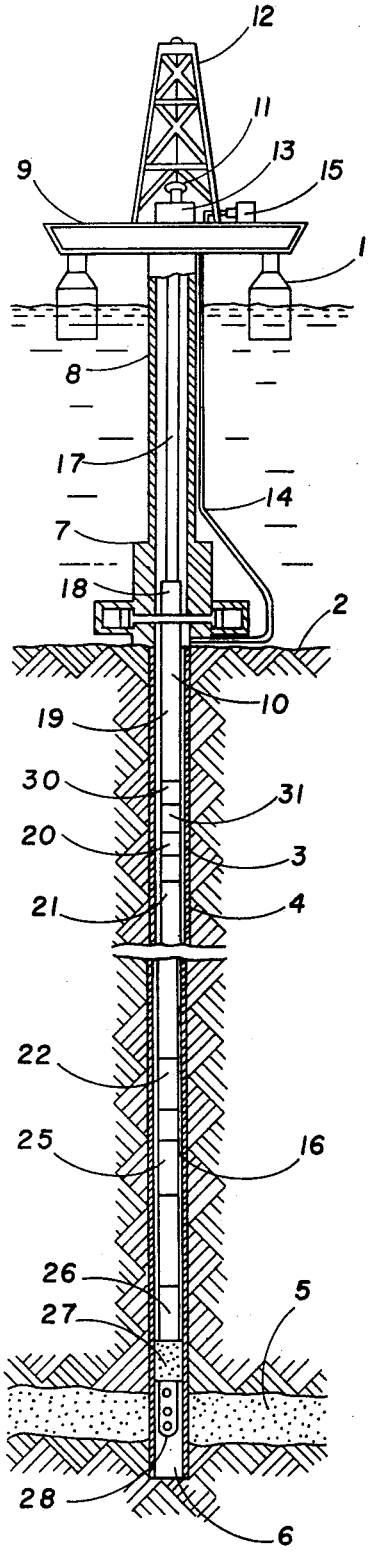

Thus when the apparatus is used as a tester valve, it can be seen that a bypass port in position 132 between seal means 130 and 131 would be in the closed position and the ball would be in the closed position as the testing string is lowered into the well. After the packer mechanism shown as 27 in FIG. 1 is set, weight is added to the tester valve causing the outer housing assembly to move downwardly collapsing the slip joint section 38. When the bypass port at 132 passes the sealing means 130, the bypass would be opened to balance the pressure in interior bore 39 across the ball in order that the ball 53 may be easily rotated to the open position.

To close such a tester valve, the testing string 10 would be raised from the surface causing the apparatus slip joint section 38 to expand moving the outer housing assembly upwardly and rotating the ball 53 to the closed position. Extension spring 71 would add a force through the operating mechanism to rotate the ball to the closed position by the action of pin 61 in hole 62. After the ball 53 had been rotated to the closed position the bypass port at 132 would be again repositioned between sealing means 130 and 131 to close the bypass. The cooperating faces at 85 would ensure that the ball 53 is moved to its fully closed position by exerting a downwardly directed force to intermediate bypass mandrel 68 and connected operating mandrel 63.

Other embodiments which work equally well and are equivalent to the embodiments shown may be imagined by one skilled in the art. The attached claims are intended to cover such equivalent embodiments of the invention which may occur to one skilled in the art.

What is claimed is:

1. An apparatus for use in a testing string extending to a submerged formation in an oil well comprising:

slip joint means in the testing string for absorbing wave motion;

means above said slip joint means for collapsing said slip joint means in the event said testing string is freely lowered into said oil well;

full opening valve means in said testing string above said slip joint means for controlling fluid flow through the interior of said testing string, said valve means being in the normally open position when the valve means is in tension, and being in the closed position when said valve means is in compression; and operating means in said valve means for maintaining said valve means in the open position when tension appears between the ends of said valve means, and for closing said valve means when compression appears between the ends of said valve means.

2. The apparatus of claim 1 wherein said full opening valve means further comprises a ball valve rotatable between an open and closed position.

3. The apparatus of claim 2 further comprising a spring in said operating means for maintaining said full opening valve means in the open position until subsequent to the collapsing of said slip joint means.

4. The apparatus of claim 2 further comprising a bypass around said ball valve for opening prior to the opening of said ball valve for equalizing a pressure differential across said ball when the ball is in the closed position and the bypass is in the open position; and an extension spring in said operating means for applying an opening force to said ball after the bypass is open for rotating the ball to the fully open position after said pressure differential has been reduced sufficiently to allow said ball to be rotated.

5. The apparatus of claim 4 further comprising a piston in said operating means having a first side exposed to the pressure in the annulus of the well exterior to said valve means, and having a second side exposed to pressure in the interior of the testing string for exerting a force at least partially cancelling hydraulic forces acting on said testing string tending to close said full opening valve means.

6. A valve apparatus for use in an oil well comprising:

a tubular housing having an inner bore therethrough;

a sliding mandrel for relative movement with said tubular housing between a telescopically contracted position and a telescopically expanded position;

a valve longitudinally fixed in said inner bore and rotatable between an open and a closed position for controlling fluid flow through said inner bore;

an operating means for opening and closing said valve and movable between a first and second position as said tubular housing and said sliding mandrel move between said telescopically contracted and telescopically expanded positions;

connecting means arranged for connecting said opeating means with said sliding mandrel during movement of said mandrel in a first direction for moving said operating means from its first position to its second position, and further arranged for disconnecting said operating means from said mandrel means during movement of said mandrel in a second opposite direction; and spring means connected on one end to said tubular housing and on a second end to said operating means for biasing said operating means toward its first position as said mandrel is moving in its second opposite direction.

7. The apparatus of claim 6 wherein said tubular housing has a chamber between said tubular housing and said sliding mandrel; and said apparatus further comprises a piston affixed to said sliding mandrel and arranged in said chamber to have pressure in the well annulus exposed to one side of said piston and pressure in said inner bore exposed to the other side of said piston for providing force responsive to the difference of said pressures for opposing the closing of said valve means.

8. The apparatus of claim 6 wherein said valve comprises a full opening ball valve rotatable between the open and closed positions.

9. The apparatus of claim 8 wherein said operating means includes bypass means around said full opening ball valve for equalizing a pressure differential across said full opening ball valve when said valve is closed and said bypass means is open; and said spring means biases said valve toward the open position to open said valve when said pressure differential is reduced sufficiently for said valve to open.

* * * * *